US005800210A

United States Patent [19]

Sparks, Jr. et al.

[11] Patent Number: 5,800,210

[45] Date of Patent: Sep. 1, 1998

[54] SEAMED SPACER SLEEVE FOR ELECTRICAL CONNECTOR HOUSING

[75] Inventors: Harry Lee Sparks, Jr., Lewisville; Galen Monroe Martin, Jamestown, both of N.C.

[73] Assignee: The Whitaker Corporation, Wilmington, Del.

[21] Appl. No.: 641,249

[22] Filed: Apr. 30, 1996

[51] Int. Cl.[6] ..... H01R 13/73

[52] U.S. Cl. ..... 439/573

[58] Field of Search ..... 439/573, 78, 55, 439/81, 82

[56] References Cited

U.S. PATENT DOCUMENTS

| | | | |
|---|---|---|---|
| 4,318,157 | 3/1982 | Rank et al. | 361/386 |
| 4,460,225 | 7/1984 | Moore et al. | 339/28 |
| 4,545,632 | 10/1985 | Maier et al. | 339/18 R |
| 4,934,950 | 6/1990 | Green et al. | 439/681 |
| 5,259,781 | 11/1993 | Baumberger et al. | 439/362 |
| 5,316,487 | 5/1994 | Clark | 439/573 |

FOREIGN PATENT DOCUMENTS

| | | | |
|---|---|---|---|
| 249646 | 12/1987 | European Pat. Off. | 439/573 |

*Primary Examiner*—Khiem Nguyen
*Assistant Examiner*—Eugene G. Byrd
*Attorney, Agent, or Firm*—Mary K. Van Atten; Bradley N. Ditty

[57] ABSTRACT

A housing assembly (5) for use with electrical/electronic components includes a housing (10), spacer sleeves (20) spaced along a periphery of the housing (10), and at least one electrical component (40) in a cavity (6) of the housing (10). Seamed spacer sleeve (20) is insert molded into the dielectric material of the housing (10) and is arranged to withstand compressive forces from a fastener inserted therein and includes dimples (21) for receiving the plastic material during an injection molding process and is a stamped and formed member. The use of an insert molded spacer sleeve reduces the cost of the housing (10) and provides a means of transmitting compressive forces which avoids compressive forces acting on the housing (10) thereby avoiding cracking and fracturing of the housing (10).

12 Claims, 4 Drawing Sheets

SEAMED SPACER SLEEVE FOR ELECTRICAL CONNECTOR HOUSING

The present invention relates to an electrical connector housing for supporting and protecting a plurality of electrical/electronic circuits and electrical interconnections. More particularly, the present invention relates to a spacer sleeve of the housing, which sleeve is a compression load-bearing member that is insert molded or pressed into the housing.

BACKGROUND OF THE INVENTION

Electrical/electronic component housings used in the automotive industry must be adapted for use in particularly harsh conditions, such conditions include vibration, temperature-cycling induced stresses, and shock forces. Electrical/electronic component housings used in such conditions must be structurally robust, particularly where the housing protects fragile electrical circuitry. Such housings often require a bolt or other fastening member to be inserted through a fastening receiving section of the housing for mounting the housing to an operating equipment component, thus the housing, in addition to being subjected to the aforementioned harsh conditions, will be subjected to substantial compressive forces generated by the fastening member. The compressive forces induce stress concentrations in the housing material which, when combined with the harsh conditions noted above, may cause plastic creep, cracking, or fracture of the housing, thereby exposing the electrical circuitry therein to contaminants or harmful mechanical agents.

A typical electrical connector housing using a fastener for connecting electrical/electronic components is disclosed in U.S. Pat. No. 4,545,632, which connector comprises a top housing member connected to a lower base member by a screw fastener which screws into a threaded bushing embedded in the base member. Compressive forces generated by the fastener will act directly on the housing, thereby inducing stress concentrations in the housing material, and thus vibration and temperature cycling induced stresses will cause cracking or fracture of the housing material.

SUMMARY OF THE INVENTION

To solve the foregoing problem, the present invention provides a housing for use with an electrical circuit, the housing is formed of a dielectric material and comprises: an electrical contact receiving section for receiving an electrical contact of the circuit; and a spacer sleeve for receiving a fastener therethrough for fastening the housing to a component, spacer sleeve is a stamped part associated with the housing, whereby forces generated by the fastener are generally transmitted through the spacer sleeve to the component, thereby avoiding stress cracking of the housing material.

The sleeve advantageously comprises a stamped metal piece with a seam which extends along the full length of the sleeve, and the sleeve defines a generally shell-like configuration, preferably a generally cylindrical configuration for receiving a fastener. The sleeve preferably comprises at least one dimpled recess for receiving the dielectric material during a molding process. More particularly, the sleeve is insert molded in the housing thereby fixing the sleeve in the housing and minimizing productions costs. The pressures of the insert molding process force the housing material against the sleeve, and the material will shrink as it cools; however, a mass of plastic will remain in the dimple for retaining the sleeve in the housing.

DETAILED DESCRIPTION OF THE INVENTION

Figure 1:
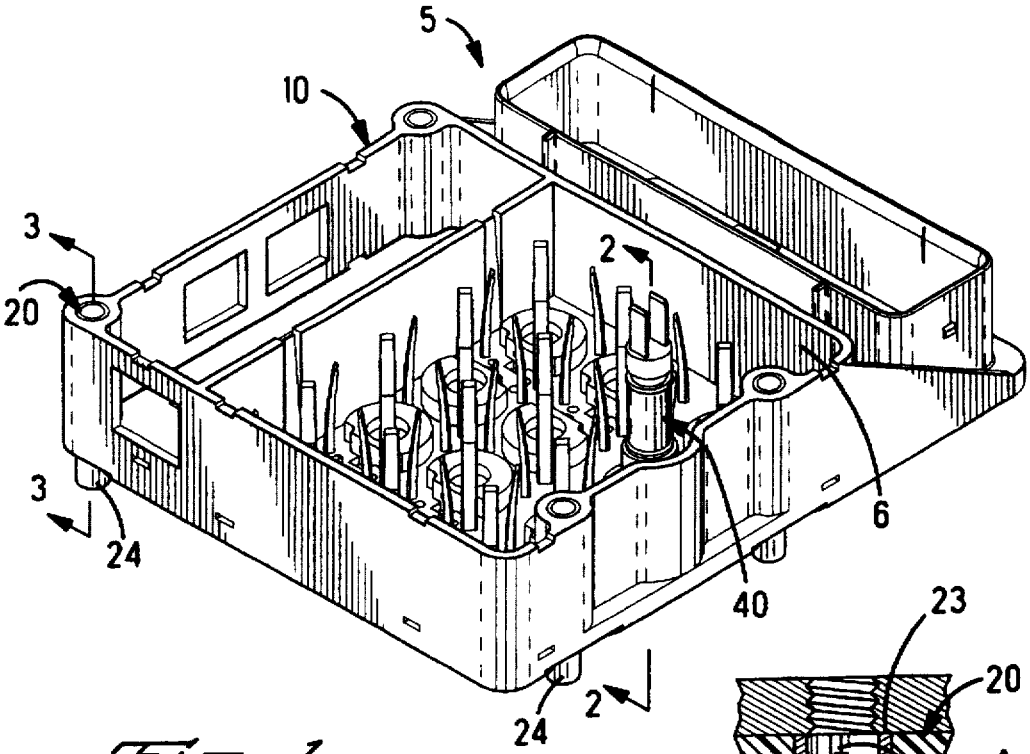
FIG. 1 is an isometric view of the electrical/electronic component housing according to the present invention.
Figure 2:
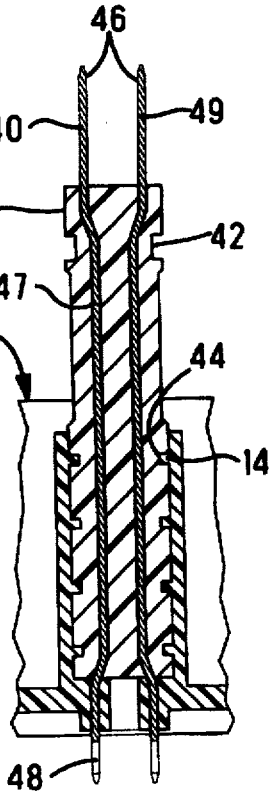
FIG. 2 is a cross sectional view of an electrical component for use with the housing of FIG. 1.
Figure 9:
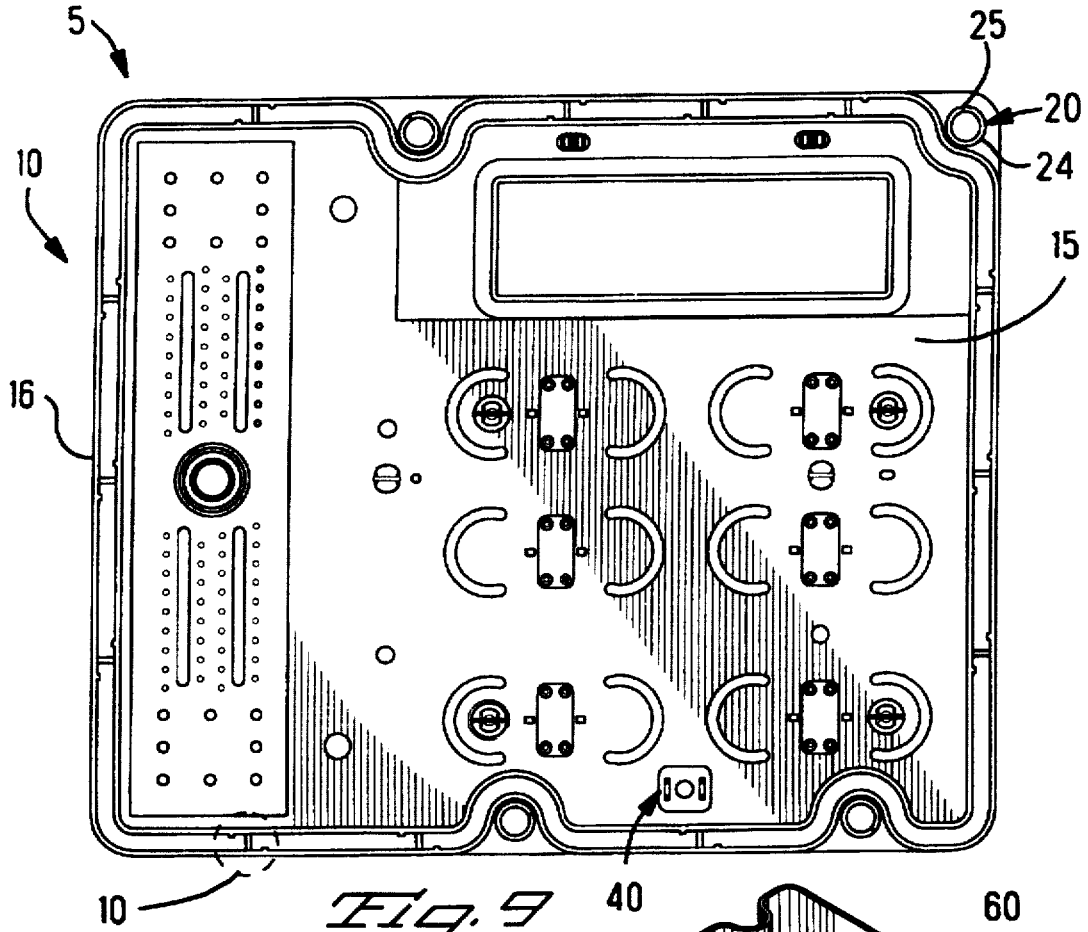
FIG. 9 is a bottom view of the housing of FIG. 1 where electrical/electronic interfaces are located.
Figure 10:
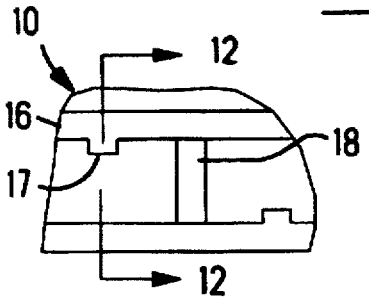
FIG. 10 is a detail drawing of a peripheral section of the housing of FIG. 9.
Figure 14:
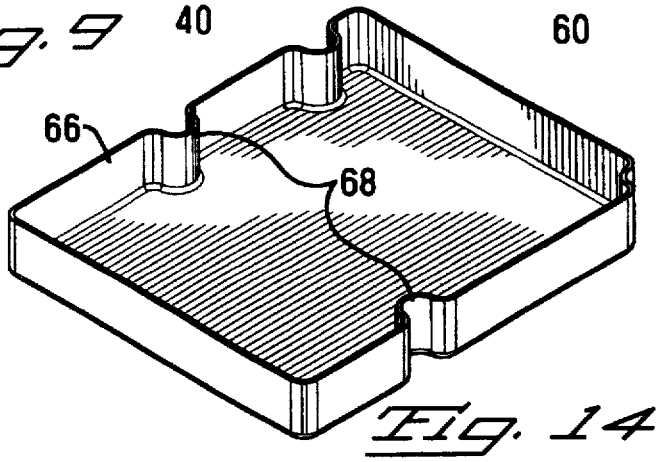
FIG. 14 is an isometric view of a cover which comprises the cover wall of FIG. 11.

Referring to FIGS. 1, 9, and 14 the housing assembly 5 of the present invention will be described. Housing assembly 5 includes: a housing 10 having a cavity 6; spacer sleeves 20 disposed at various positions on the periphery of cavity 6; at least one electrical component 40 located in the cavity 6; and a cover 60 for sealing an electrical interface surface 15 of housing 10 (see FIGS. 9 and 10).

Figure 5:
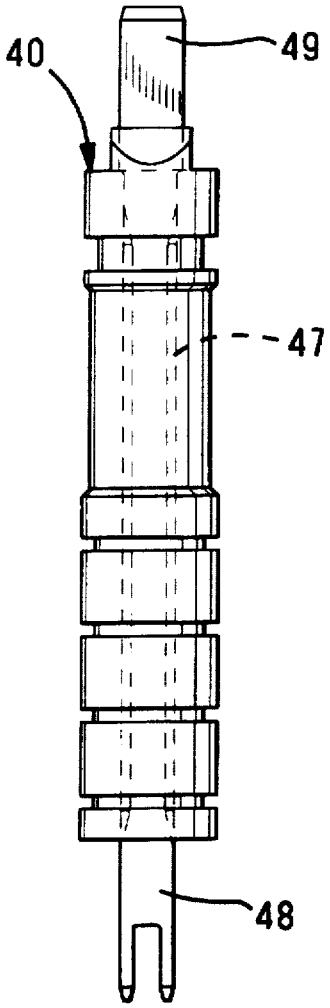
Figure 6:
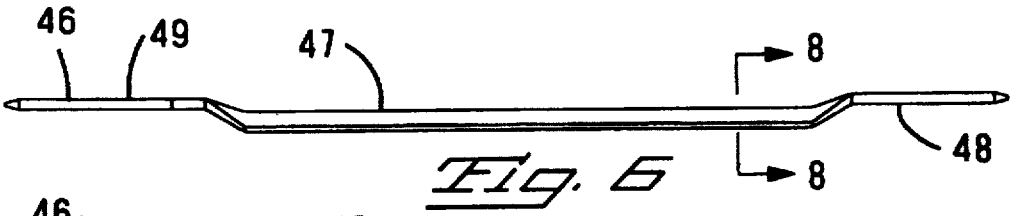
FIGS. 6–7 are side and top views of the electrical contact used with the electrical component of FIG. 2.
Figure 7:
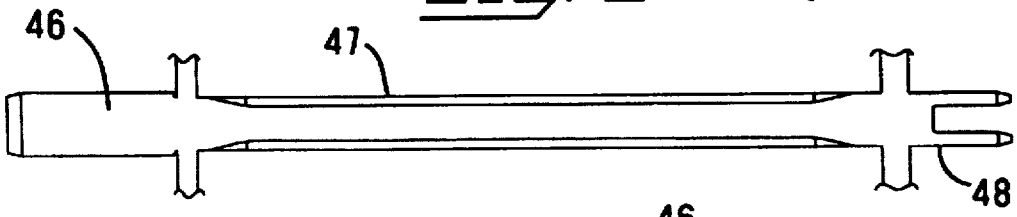

Referring now to FIGS. 2 and 3–7, the electrical component 40 for use with assembly 5 will be described. Electrical component 40 includes a plastic body 41 and electrical contacts 46. Plastic body 41: is formed of a dielectric material which is over-molded around electrical contacts 46; includes an annular recess 42 for receiving a seal therein (not shown); and further includes annular recesses 44 for receiving the material of housing 10 therein. As best shown in FIGS. 5–7, electrical contacts 46, which are substantially identical to each other, each include: a midsection 47; a forked section 48; and a tab section 49.

Figure 8:
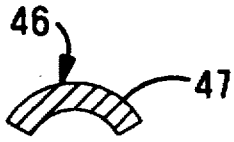
FIG. 8 is a cross sectional view of the electrical contact of FIG. 6 taken along line 8—8.

The large cross sectional area of midsection 47 (see FIG. 8) is advantageously designed to transmit a high quantum of electrical current therethrough for supplying a piece of operating equipment with electrical power. Midsection 47 comprises a generally arcuate shape for maximizing the cross sectional area of the contact 46 and the current carrying capacity of the contact 46. The arcuate shape of midsection 47 complements the arcuate shape of body 41 and thus the midsection will not protrude through the dielectric material of plastic body 41. Plastic body 41 is advantageously over-molded around contacts 46 for electrically isolating the current passing through the contacts whereby body 41 insulates the electrical contacts from each other and other electrical/electronic components within the cavity 6.

In another advantage of the present invention, recesses 44 will receive plastic material 14 of housing 10 therein (see FIG. 2) as the component 40 is being insert-molded into housing 10. Material 14 will then solidify and expand slightly so that a hermetic seal is formed between housing 10 and component 40.

Figure 3:
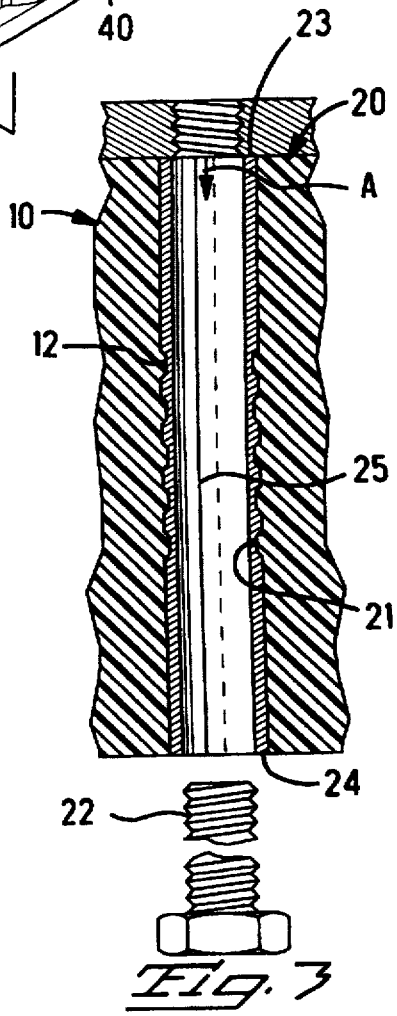
FIG. 3 is a cross sectional view of a seamed spacer sleeve for use with the connector housing of FIG. 2.
Figure 4:
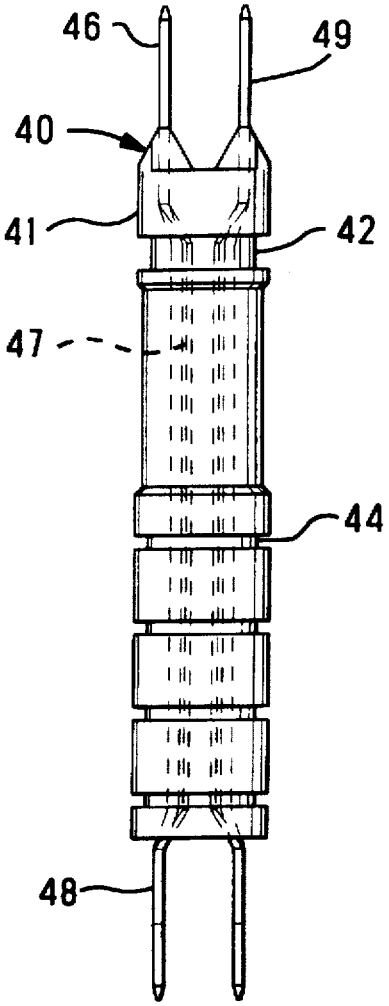
FIGS. 4–5 are front and side views of the electrical component of FIG. 2.

Now referring to FIGS. 1, 3, and 13–15, the spacer sleeve 20 of the present invention will be described. As is best shown in FIG. 3, the spacer sleeve comprises a cylindrical shell having external recesses, preferably, dimples 21 with housing material therein. A top edge 23 is generally flush with a top surface of housing 10, and a bottom edge 24 extends below electrical interface area 15 of housing 10. Sleeve 20 comprises an axial seam 25 along its length, which is formed during the stamping and forming process. The sleeves 20 are insert molded into the housing 10, and the material 12 of housing 10 will flow into the dimples 21 and solidify, thereby sealingly gripping the spacer sleeve in the housing 10. Preferably, the seam 25 is, as much as possible, closed during the sleeve's forming process, thereby preventing contaminants from entering into the sleeve and contributing to corrosion of the fastener and sleeve 20.

The spacer sleeve 20 is an inexpensive stamped and formed, generally cylindrical shell member. The main purpose of the seamed spacer sleeve 20 is to receive a fastening member 22 therethrough (see FIG. 3), inserted along the direction of arrow A, whereby the sleeve is subjected to compressive forces generated by the fastening member. In this way, the compressive forces generated by the fastener will not be transmitted to the housing 10, thereby avoiding cracking or fracture of the housing.

For enhanced retention in the housing 10, the seamed spacer sleeve 20 may comprise various outer surfaces for interfacing with the housing material. The spacer sleeve embodiments 120, 220, and 320 of FIGS. 13–15 each include a respective seam 125, 225, 325. Spacer sleeve 120 includes a series of annular rings 121 having an apex section for projecting into the housing material. Preferably, spacer sleeve 220 includes dimples 221 for receiving the housing material therein during the insert molding process. Spacer sleeve 320 includes annular recesses 321 for receiving the dielectric material therein during the insert molding process. Each one of the foregoing spacer sleeves will be rigidly mounted to the housing 10 during the insert molding process and will be arranged to withstand compressive forces generated by respective fasteners inserted therethrough, thereby avoiding the transmission of compressive forces to the housing and avoiding cracking and fracturing of the housing material.

Figure 11:
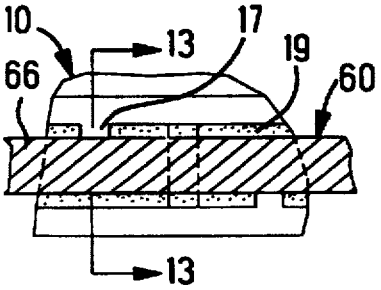
FIG. 11 is a top view of the peripheral section of FIG. 10 with a cover wall section inserted and sealed therein.
Figure 12:
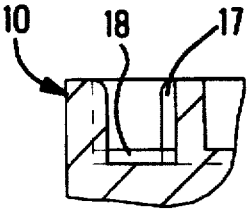
FIG. 12 is a side view of the detail of FIG. 9 taken along line 12—12.
Figure 13:
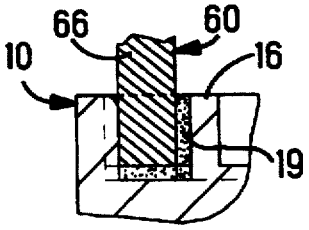
FIG. 13 is a side view of FIG. 11 taken along line 13—13.
Figure 15:
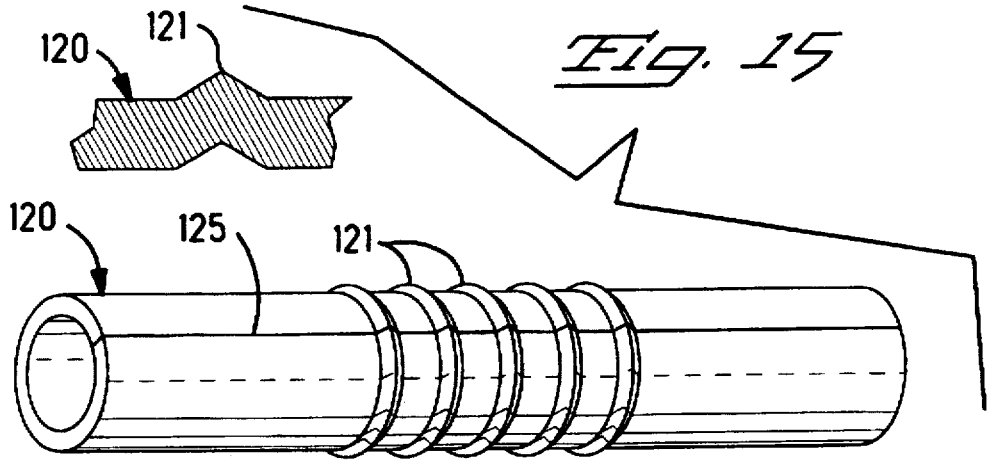
FIGS. 15–17 are views which depict various configurations of the spacer sleeve of FIG. 3.
Figure 16:
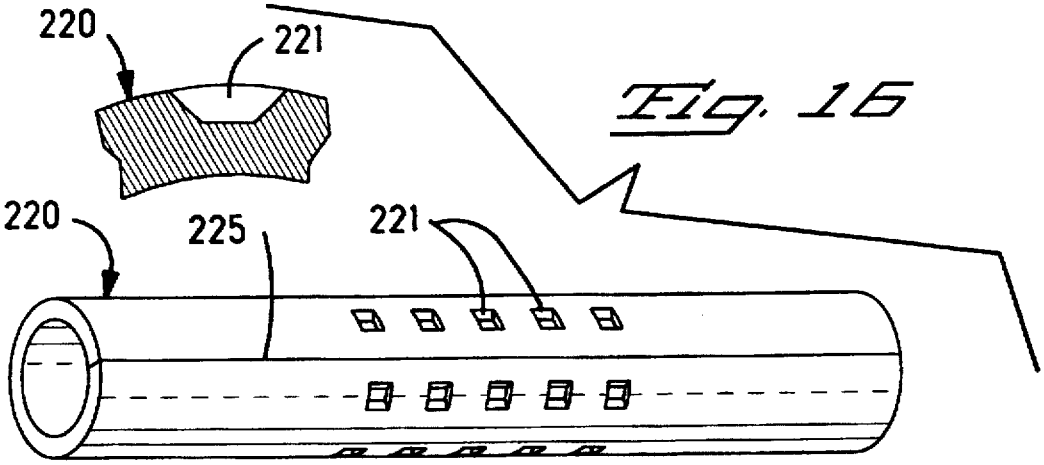
Figure 17:
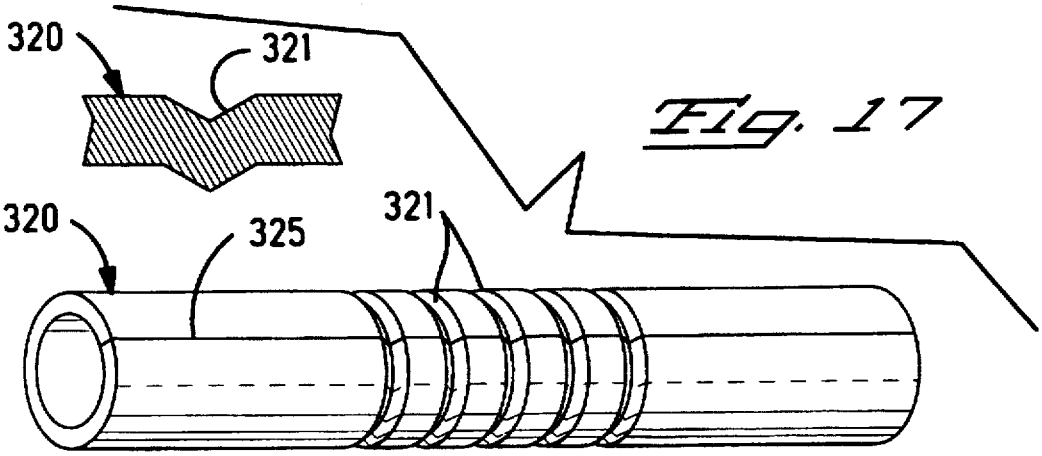

Now referring to FIGS. 9–13, the sealing of cover 60 to housing 10 will be described. Referring to FIG. 9, housing 10 includes a double wall section 16 for receiving a wall section 66 of cover 60 therein. The double wall section 16 includes projections 17 and a base section 18 for receiving a sealing wall 66 of cover 60, as shown in FIG. 11. The application of, for example, a silicone based sealant material 19 in double wall section 16, prior to insertion of wall section 66 therein, ensures that the electronics components area 15 on the bottom of housing 10 will be sealed off from contaminants which would otherwise negatively effect performance of the electrical circuitry. Projections 17 advantageously allow the sealant material 19 to flow into the spaces between the wall 66 and double wall 16. Moreover, the base sections 18 likewise allow the sealant material 19 to flow into the space below the cover wall 66 thereby providing a sealing interface along the face of the wall 66 (see FIG. 12).

Thus, while a preferred embodiment of the invention has been disclosed, it is to be understood that the invention is not to be strictly limited to such embodiment but may be otherwise variously embodied and practiced within the scope of the appended claims. For example, although the present invention is described in terms of an insert molding process for fixing the sleeve 20 in housing 10, it is contemplated that the sleeve 20 can be press fit into the housing 10 by a machine or tool. Additionally, although use of the spacer sleeve 20 avoids stress cracking in the housing material, the spacer sleeve also withstands and assists in establishing a target preload in the fastener 22 when the components are initially assembled. Therefore, over the life of the product, the spacer sleeve will be an integral part of a system that will maintain a tensile force in the fastener which clamps the assembly together.

Accordingly, what is claimed is:

1. A housing for use with an electrical circuit, said housing is formed of a dielectric material, and said housing comprises:

an electrical contact receiving section for receiving an electrical contact of said circuit; and a spacer sleeve for receiving a fastener therethrough for fastening the housing to a component, said spacer sleeve is a stamped part associated with the housing, whereby forces generated by the fastener are generally transmitted through said spacer sleeve to the component.

2. The housing of claim 1, wherein said sleeve is a stamped metal piece.

3. The housing of claim 1, wherein said sleeve comprises at least one dimple-like recess for receiving said dielectric material therein thereby fixing said spacer sleeve in said housing.

4. The housing of claim 1, wherein said sleeve is insert molded in said housing thereby fixing said sleeve in said housing.

5. The housing of claim 1, wherein said sleeve comprises a seam along a portion of its length.

6. The housing of claim 1, wherein the seam extends along the full length of the sleeve.

7. The housing of claim 1, wherein the sleeve defines a generally shell-like configuration.

8. The housing of claim 7, wherein the shell comprises a generally cylindrical configuration.

9. The housing of claim 1, wherein the shell is compressively stressed by the housing material for retaining the sleeve in the housing.

10. The housing of claim 1, wherein the sleeve comprises a surface which is generally flush with a surface of said housing.

11. The housing of claim 1, wherein the sleeve is pressed into the housing.

12. The housing of claim 1, wherein the spacer sleeve preloads the fastener when the components are initially assembled, thereby maintaining a tensile force in the fastener which clamps the assembly together.

* * * * *